United States Patent [19]

Shank

[11] Patent Number: 4,989,503

[45] Date of Patent: Feb. 5, 1991

[54] WIND CONTROLLED ROOF VENTILATION SYSTEM

[76] Inventor: Sanford L. Shank, 1066 Chicago Ave., Harrisonburg, Va. 22801

[21] Appl. No.: 484,524

[22] Filed: Feb. 26, 1990

[51] Int. Cl.[5] ..... F24F 7/02

[52] U.S. Cl. ..... 98/42.2; 98/73

[58] Field of Search ..... 98/42.2, 58, 59, 60, 98/64, 65, 66.1, 68, 70, 71, 73, 74

[56] References Cited

U.S. PATENT DOCUMENTS

| | | | |
|---|---|---|---|
| 1,420,141 | 6/1922 | Pennington | 98/73 |
| 1,533,344 | 4/1925 | Singleton | 98/64 |
| 2,529,491 | 11/1950 | Gadzuk | 98/68 X |
| 4,593,610 | 6/1986 | Chabut | 98/73 X |

FOREIGN PATENT DOCUMENTS

| | | | |
|---|---|---|---|
| 2910447 | 9/1980 | Fed. Rep. of Germany | 98/42.2 |
| 361486 | 7/1906 | France | 98/42.2 |
| 33523 | 3/1980 | Japan | 98/73 |

*Primary Examiner*—Harold Joyce

*Attorney, Agent, or Firm*—Mason, Fenwick & Lawrence

[57] ABSTRACT

A wind-directed ventilator hood assembly for a narrow elongated air exit opening in the roof of a farm building spanning a long portion of the roof, including hood supporting uprights projecting upwardly from the air exit opening at plural spaced locations, a horizontal elongated pivot shaft journaled in the uprights above the exit opening, and a pivoted elongated hood for covering the opening having transverse beams and a hood roof covering the beams. The hood roof has downwardly diverging side panel portions inclined about 90° to each other and the beams are fixed to said shaft for rotation therewith between a first position opening toward one of a pair of upwardly inclined roof sections with a side panel portion disposed vertically adjacent one roof section and a section position opening toward the other roof section. A wind vane is supported for movement responsive to wind force to activate a vane direction sensing mechanism and driving the hood to the first and second hood positions.

6 Claims, 2 Drawing Sheets

WIND CONTROLLED ROOF VENTILATION SYSTEM

BACKGROUND AND OBJECTS OF THE INVENTION

The present invention relates in general to roof ventilators, and more particularly to wind directable ventilators for the roofs of barns, poultry buildings and the like.

It has been generally recognized that there is need for good ventilation in farm buildings, poultry buildings, and the like, including a minimum opening of about 2 inches per 10 feet of building width in the comb or upper regions of the roof of the building. The original was 14 inches because building was 66 feet. It is generally considered that some provision should be made for a free flow of air in the highest portion of a barn. An upwardly sloping roof with a sufficiently large opening allows for the appropriate flow of air, but special arrangements must be provided to provide appropriate weather protection. For example, providing a pair of roof sections sloping converging upwardly from the eaves or building side walls but terminating at different levels, with a laterally falling opening between the roof sections in the uppermost region, with one edge overhanging the other, does not give protection from rain when the wind is driving the rain from the direction in which the opening is facing. Efforts have been made to provide appropriate flow of air by leaving an opening of varying size depending on building width without any cover at the ridge or uppermost portion of the two upwardly converging roof sections, without providing any cover. Although the upward draft of the air flowing through such a ventilating roof arrangement would keep some of the rain out of the barn, such arrangements do not provide the building with adequate rain and snow protection.

An object of the present invention is the provision of a wind directable roof ventilator assembly for barns or the like which provide adequate ventilation, while at the same time protecting the building and its contents from rain. The arrangement is such that the size of the air flow opening may be varied through an appropriate range to meet a wide variety of job requirements.

Another object of the present invention is the provision of a wind directed roof ventilator system for barns or the like, wherein a tiltable ventilator hood assembly is positioned in upwardly spaced covering relation to a ventilation opening running along the peak or ridge portion of a pair of upwardly sloping barn roof sections along substantially the length of the barn, together with a wind-direction-responsive vane mechanism which is positioned in response to wind direction and through a linkage system varies the position of the hood structure to minimize entry of rain through the ventilating opening.

Other objects, advantages and capabilities of the present invention will become apparent from the following detailed description, taken in conjunction with the accompanying drawings showing a preferred embodiment of the invention.

DETAILED DESCRIPTION OF A PREFERRED EMBODIMENT

Figure 1:
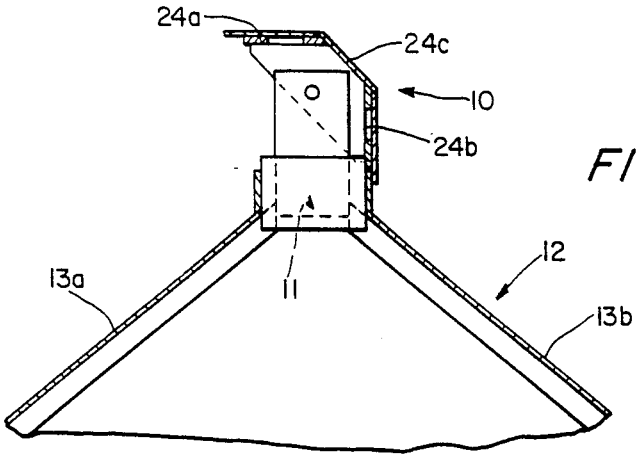
FIG. 1 is a vertical section view through the upper portion of a barn roof, showing the ventilating opening and adjustable hood arrangement associated therewith, providing the roof ventilator system of the present invention.

Referring to the drawings, wherein like reference characters designate corresponding parts throughout the several figures, the wind directed roof ventilator system of the present invention comprises an elongated pivoted, tiltable hood structure, indicated generally by the reference character 10, supported in elevated position spaced a short distance above an air outlet opening, indicated generally by the reference character 11, provided in the roof 12 in at approximately the midplane or central region of a building such as a barn or similar farm building requiring ventilation. In the illustrated embodiment, the roof is of the conventional ridge or gable type, formed of two main roof sections or halves **13*a*,13*b* extending in upwardly convergent relation from the eaves located at the side walls 14 of the farm building to a central vertical midplane ridge 15 which longitudinally spans the length of the building. No. 15 is optional, depending on the framing structure of the building. The upwardly and inwardly inclined roof sections or halves 13*a*,13*b* may be conventionally formed of rafters 16 formed of rafter beams or truss structures spaced an appropriate distance apart in side-by-side relation lying in parallel transverse vertical planes, secured at their uppermost ends to the center ridge beam or "ridge pole" 17, and covered from the lowermost ends forming overhanging eaves to a location near the ridge with the usual sheathing and roofing materials such as metal roofing or shingles or the like. In case of some trusses, the ridge pole may be replaced by members attached to the top of the trusses just below the opening. In the illustrated embodiment, the uppermost edge of the portions of the roof sections 13*a*,13*b* covered by the sheathing and roofing material terminates about 14" inches from the uppermost ends of the rafters 16, thus providing an air outlet opening 11** longitudinally spanning the length of the building at the ridge zone, to provide adequate air outlet from the building for ventilation purposes. In the illustrated embodiment, the roofing material is corrugated metal roofing.

The hood structure 10 of the preferred embodiment comprises a generally box-like base structure 20 formed of flashing support boards **20*a* and transverse horizontal support members 20*b*, between pairs of which vertically extending main shaft supporting uprights 21 extend, with the horizontal support members 20*b* secured to the upright shaft supports 21 and the flashing support boards 20*a* secured at their ends to the ends of the horizontal cross support members 20*b*. The lower portions of the supporting uprights 21 are attached to the main roofing truss or rafter members of the barn at the bottom and are each provided with a circular hole 21***a*, designed in alignment along a horizontal shaft axis to receive an elongated main hood support shaft 22 and permit rotation of the shaft 22 about its center axis. In one embodiment, the holes 21*a* are sized to allow for about 1/16th inch tolerance for the rotating shaft 22.

The ventilator hood 23 is an elongated tiltable covering hood for the opening 11 which spans the entire length of the opening at the ridge 15 of the building and comprises a plurality of longitudinally spaced transversely extending, generally isosceles trapezoidal wooden beams formed of about 2 by 10 inch or 2 by 12 inch lumber, arrange in transverse parallel vertical planes perpendicular to the axis of shaft 22. Alternate construction for the support system and hood members may be metal. The beams 24 are anchored to the shaft 22 to turn with the shaft, for example by a pair spaced angle-iron members 25 extending vertically adjacent the center of each ventilator hood beam 24 with the flange 25*a* thereof fastened to and against the confronting face of the associated beam 24 and the other flange 25*b* extending outwardly therefrom with the flanges 25*b* of the pair of angle-iron members 25 on each associated beams spaced apart a distance corresponding to the outer diameter of the main shaft 21 and secured thereto by a suitable attachment bolt. Through bolts 24' may be provided to span the width of the shaft supporting uprights 21 above the holes 21*a* to resist spilling in strong winds. The plurality of ventilator hood beam members 24 include a pair of opposite upwardly converging inclined edges 24*a, b*, and a straight top edge surface 24*c* paralleling the bottom edge 24*d*, with the edges 24*a, b*, and *c* forming support surfaces for hood sheathing 26 secured to the respective transverse ventilator hood beam members 24 and covered with suitable roofing material 27 covering the top of the hood. The hood beam members 24 are long enough to allow the hand to assume limit positions at which the hood coverings over edge 24*a* or 24*b*, whichever is in the lower or down position, slants inwardly at the bottom and the edge 24*a* or 24*b* at the top slopes away from the opening; thus allowing air leaving the barn to flow out more freely and draining rain off the back of the ventilator hood covering. A grease nipple 18*b* may be provided in each of the upright support members 21 communicating with the associated hole 21 to lubricate the shaft portions within opening 21.

Figure 2:
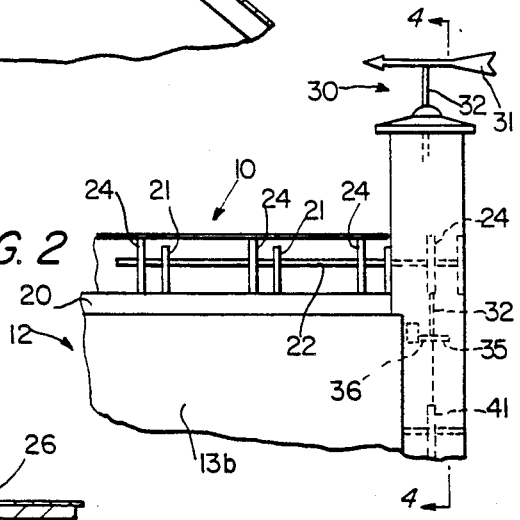
FIG. 2 is a fragmentary side elevational view of the ventilator system and adjacent roof portions shown in FIG. 1.
Figure 3:
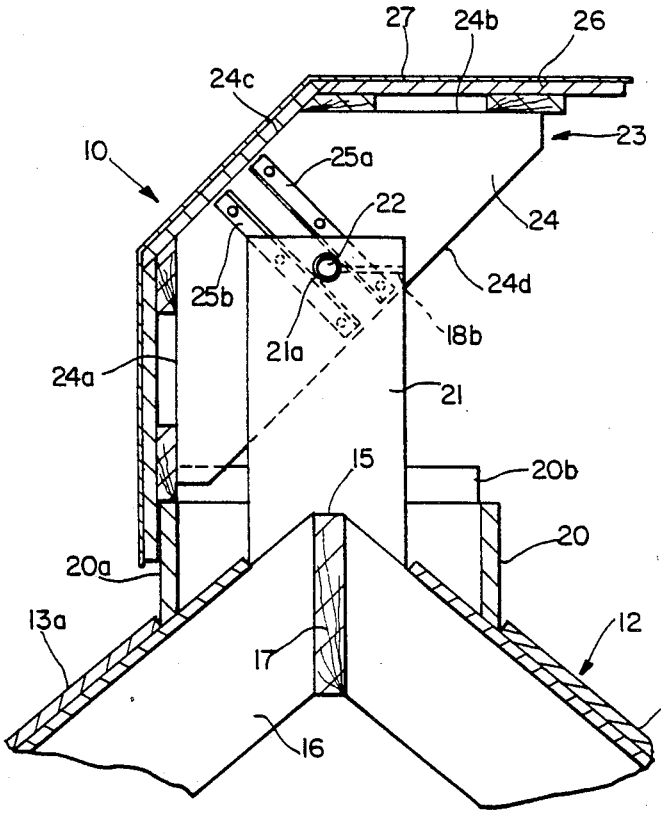
FIG. 3 is a fragmentary vertical section view similar to FIG. 1, with the hood facing in the opposite direction.
Figure 4:
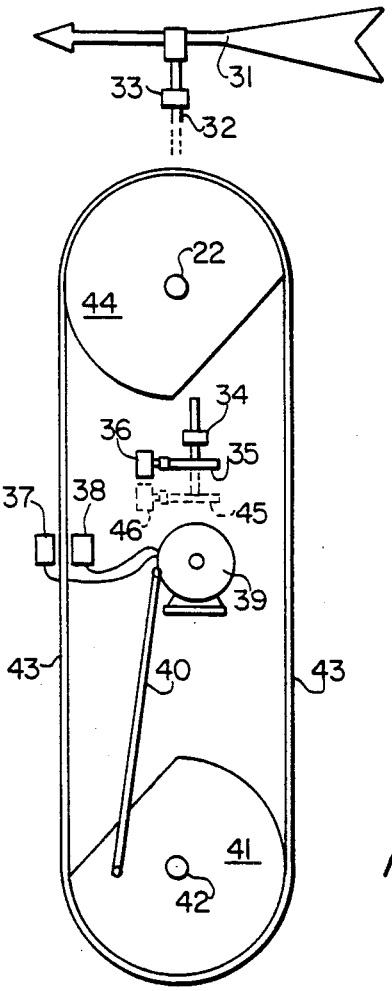
FIG. 4 is a fragmentary vertical section view taken along the line 4—4 of FIG. 2, showing the wind controllable weather vane and control linkage mechanism, with the hood assembly disposed in one limit position.
Figure 5:
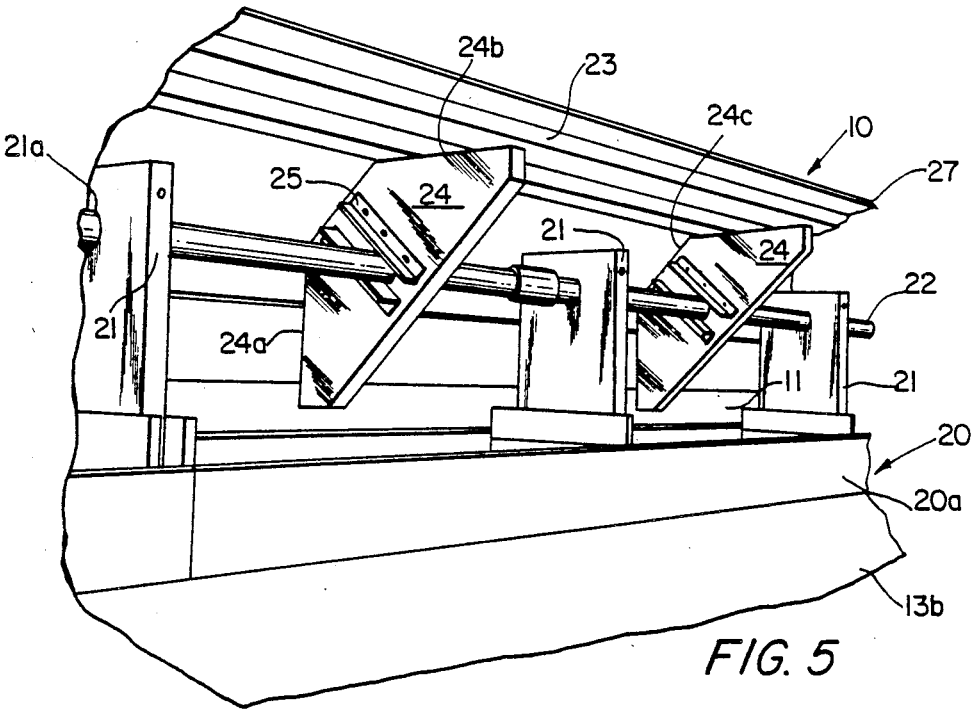
FIG. 5 is an enlarged perspective view showing details of construction of the hood and hood supporting mechanism.

The ventilator hood 23 is tiltable between a first limit position shown in FIG. 2 wherein the hood covering over edge 24*a* of the hood beam members 24 engages at its lower edge with the roofing material for the roof section 13*a* so that the hood opens in a direction facing towards the roof section 13*b* for air outflow, to an opposite or second position wherein the hood opens toward the opposite roof section 13. The hood position is under control of a weather vane controller, generally indicated by the referenced character 30, supported in a suitable structure rising above the hood 23 so as to be in an unobstructed position subject to reliable positioning by the wind as the wind changes directions. In the illustrated example, the weather vane controller includes a weather vane 31 mounted in a cupola by supporting the weather vane 31 on a elongated shaft 32 rotatively journaled in a top ball bearing assembly 33 and a stabilizing lower ball bearing assembly 34 suitably supported in the cupola. The weather vane shaft 32 may have an inverted bowl shaped hood supported thereon to serve as a cover over the top ball bearing 33. At the lower end of the weather vane shaft 32 is fixed a control cam 35 for operating a roller arm lever type follower or actuator of a snap action switch 36, provided with both a normally open and a normally closed circuit. The switch 36, in turn, activates one of a pair of time delay relays 37, 38 when the roller of the switch arm is depressed by a lobe on the control cam 35. The other time delay relay 38 is activated when the roller on the arm of the switch 36 is released by movement of the control cam 35.

The time delay relay 37 activates a drive motor 39 having a drive rod 40 connected to its output shaft and to a pivotally supported hood positioning wheel member 41. The hood positioning wheel member 41 is mounted on a pivot shaft 42 and is connected to the drive rod 40 at an eccentric location spaced from the pivot shaft 42, and includes connecting link members 43, wrapped around the semicircular hood positioning wheel at the lower end, attached to the wheel beyond the edge of the semi-circle, and pivotally connected at their upper ends to the top semi-circular wheel 44 at similar eccentric locations spaced from the shaft 22 to tilt the hood 23 to either the first or second limit positions upon movement of the hood positioning wheel member 41 to similarly tilted positions. Thus the weather vane 31 turns by the force of the wind and this activates the mechanism which tilts the hood to either of the two limit positions. The time delay switches 37, 38 avoid rapid oscillating of the hood from side to side when the wind is rapidly changing directions. The amount of time delayed can be set, in the switches employed in the illustrated embodiment, from about 1.8 seconds to about 3 minutes.

Additionally, a second cam 45 may be provided on the weather vane shaft 32, in the preferred embodiment, to activate a second switch 46 for deactivating the main control switch 36 when the weather vane is positioned in a direction parallel to the longitudinal access of the ventilator and for several degrees to either side of that position. The number of degrees to either side is adjustable. This adjustment is made variable by the amount of flat area on the second cam 45 and by adjusting the switch closer or further away from the cam. The purposes of this added switch 46 is to eliminate a rocking back and forth motion when the weather vane is in a position approximately parallel to the longitudinal access of the ventilator. The tension on this switch 46 against the cam flat zone also retards the cam's rotation away from parallel. This minimizes the possibility of a light breeze swinging the ventilator from side to side.

Also a manual switch can be incorporated in the circuit to turn on and off the main control circuitry involving the switches 37, 38 and the drive motor 39, and an additional bypass switch may be provided, if desired, to bypass the cam actuated second switch 45 to allow the ventilator to rotate with all changes of wind direction.

I claim:

1. A wind-directed ventilator hood assembly for a narrow elongated air exit opening in the roof of a farm building spanning a long portion of the roof flanked by first and second opposite upwardly convergent roof sections, comprising hood supporting uprights projecting upwardly from the opening at plural spaced locations, a horizontal elongated pivot shaft journaled in the uprights above the opening, a pivoted elongated hood for covering the opening having transverse beams and a hood roof covering the beams, the hood roof having downwardly diverging side panel portions inclined about 90° to each other and said beams being fixed to said shaft for rotation therewith between a first position opening toward said first roof section with one of said side panel portions disposed vertically adjacent the second roof section and a second position opening toward the second roof section with the other side panel vertically adjacent the first roof section, a wind vane supported for movement responsive to wind forces, vane direction sensing means, motor means for driving the hood to said first and second hood positions, and electrical circuit means responsive to said sensing means for activating the motor means to position the hood is preselected relation to wind direction.

2. A wind directed ventilator hood assembly defined by claim 1 wherein the roof is a ridge type roof with the opening located at the ridge thereof, the opening extending a short distance laterally from said ridge, and said uprights substantially spanning the width of the opening.

3. A wind directed ventilator hood assembly as defined in claim 2, wherein the roof includes spaced paralleled rafters laterally spanning the opening, said uprights extending downwardly through the opening secured to and lapping said rafters.

4. A wind directed ventilator hood assembly as defined in claim 1, wherein the opening is flanked by flashing support boards bounding the opening along its opposite sides, the lower edges of said inclined panel portions of the hood roof abutting the top edge of the adjacent flashing support board when the hood assumes said first or second position.

5. A wind directed ventilator hood assembly as defined in claim 1, wherein said vane direction sensing means includes a vertical shaft having the wind vane fixed on the upper end thereof and having a cam adjacent the lower portion thereof and cam follower means positioned by said cam to signify wind vane position.

6. A wind directed ventilator hood assembly as defined in claim 5, including delay switch means activated by signals from said vane direction sensing means to activate said motor means in selected delayed relation thereto.

* * * * *